US010724255B1

(12) United States Patent
Harland

(10) Patent No.: US 10,724,255 B1
(45) Date of Patent: Jul. 28, 2020

(54) CONCRETE TOOL

(71) Applicant: Harland Concrete & Const. LLC, Perry, IA (US)

(72) Inventor: David Matthew Harland, Perry, IA (US)

(73) Assignee: David Matthew Harland, Perry, IA (US)

( * ) Notice: Subject to any disclaimer, the term of this patent is extended or adjusted under 35 U.S.C. 154(b) by 0 days.

(21) Appl. No.: 16/278,627

(22) Filed: Feb. 18, 2019

(51) Int. Cl.
*E01C 19/22* (2006.01)
*E04F 21/24* (2006.01)
*E01C 19/44* (2006.01)

(52) U.S. Cl.
CPC ..... *E04F 21/241* (2013.01); *E01C 19/44* (2013.01)

(58) Field of Classification Search
CPC .... E01C 19/22; E01C 19/44; E01C 2019/206; E04F 21/1655; E04F 21/24; E04F 21/241
USPC ..... 404/96, 97, 118; 15/235.4, 235.7
See application file for complete search history.

(56) References Cited

U.S. PATENT DOCUMENTS 772,597 A * 10/1904 Williamson ..... E04F 21/241 404/97
985,214 A * 2/1911 Shroyer ..... E01C 19/42 404/119
1,055,406 A * 3/1913 Mason ..... E04F 21/06 15/235.4
1,334,483 A * 3/1920 Brooks ..... E01C 19/44 404/98
1,401,487 A * 12/1921 Noble ..... E01C 19/44 404/97
1,524,728 A * 2/1925 Busch ..... E01C 19/44 404/97
1,548,452 A * 8/1925 Fyhrie ..... E01C 19/44 404/97

(Continued)

FOREIGN PATENT DOCUMENTS

CN 202483148 U 10/2012
CN 103306467 A 9/2013

(Continued)

OTHER PUBLICATIONS

Home Depot screen grab using Wayback Machine http://www.homedepot.com/p/QEP-6-in-x-2-in-Flat-Margin-Trowel-42110Q/205554670 (Year: 2015).*

(Continued)

*Primary Examiner* — Thomas B Will
*Assistant Examiner* — Katherine J Chu

(57) ABSTRACT

A concrete tool for use in a transition area between garage or overhead doors includes an elongated main body extending between a first and an opposite second end, wherein the main body extends at a slope upwardly from the first end to the opposite second end. The concrete tool further includes a right angle portion extending upwardly from the first end of the elongated main body and then outwardly, the right angle portion comprising a first generally vertical portion extending generally upwardly from the elongated main body and a second generally horizontal portion extending outwardly from the first generally vertical portion. The concrete tool further includes a first handle mounted proximate the first end of the elongated main body and a second handle mounted proximate the second end of the elongated main body.

10 Claims, 2 Drawing Sheets

(56) References Cited

U.S. PATENT DOCUMENTS 1,564,172 A * 12/1925 Busch ..... E01C 19/44 15/235.8
3,947,916 A * 4/1976 Mitchell ..... E04F 11/16 15/235.8
4,080,684 A 3/1978 Venditti
4,256,416 A * 3/1981 Bishop ..... E04G 21/10 404/119
4,723,869 A * 2/1988 Dragich ..... E04F 21/244 15/235.4
4,737,097 A 4/1988 Cotugno
4,982,470 A * 1/1991 Szabo ..... A47G 27/0487 15/235.6
5,016,319 A * 5/1991 Stigen ..... E04G 21/10 16/426
5,406,671 A * 4/1995 Green ..... E04F 21/06 15/144.1
5,468,095 A * 11/1995 Dawson ..... B28B 1/29 404/118
5,609,437 A * 3/1997 Silva ..... E01C 19/44 15/235.4
5,906,455 A 5/1999 McLaughlin
6,347,404 B1 * 2/2002 Iskra ..... A41D 13/065 182/230
6,695,531 B1 * 2/2004 Prescott ..... E01C 19/402 404/118
6,863,470 B2 * 3/2005 Eggleton ..... E01C 11/223 404/105
7,192,216 B2 * 3/2007 Casale ..... E04F 21/04 404/101
7,704,012 B2 * 4/2010 Lura ..... E01C 19/402 404/118
9,719,266 B2 * 8/2017 Lopez ..... E04G 11/36
2004/0028473 A1 * 2/2004 Craghan ..... E04F 21/05 404/119
2007/0061989 A1 * 3/2007 Kalbach ..... E04F 21/241 15/235.8
2007/0206991 A1 * 9/2007 Brotzel ..... E01C 3/06 404/118
2008/0060159 A1 * 3/2008 Martin ..... B25G 1/06 15/235.4
2009/0226257 A1 * 9/2009 Lindley ..... E04F 21/04 404/119
2010/0037411 A1 * 2/2010 Lin ..... B21D 53/60 15/235.4

FOREIGN PATENT DOCUMENTS

CN 103669806 A 3/2014
CN 205036058 U 2/2016
CN 205637178 U 10/2016

OTHER PUBLICATIONS

"Kraft Tool Concrete Curb & Glutter Trowel 3"Radius", https://www.ebay.ca/itm/Kraft-Tool-Conrete-Curb-Trowel-3-Radius-6173-/291219021345?hash=item43ce019e21:g:nzMAAOSwxN5WWnli, 8 pages, Jul. 30, 2017.
QUTOO, "Coving Trowels", http://qutoo.com.au/product/coving-trowels, 4 pages, 2017.

* cited by examiner

CONCRETE TOOL

FIELD OF THE INVENTION

The present invention relates to concrete finishing. More particularly, but not exclusively, the present invention relates to a specialized concrete tool for use in situations where a garage or overhead door will seal with the concrete.

BACKGROUND

Hand trowels are commonly used in finishing concrete. Generally, hand trowels are swiped across concrete in order to obtain a desired evenness of a surface and to remove lumps. Although normal hand trowels may be appropriate for flat even surfaces, issues are created in situations where surfaces are intended to have a slope.

One particularly troublesome situation relates to laying concrete where a garage or overhead door will seal with concrete. This may be referred to as a transition area in that the concrete floor transitions to the outside. In such a situation, when one uses a hand trowel it is very difficult to provide consistent and uniform slope along the length of the transition area underneath a garage or overhead door. Without a uniform slope the door will not seal evenly across its length. Moreover, if there is not a uniform slope, water may not run away from the door. It is desirable for the transition area to slope downwardly towards the outside so that water will run away from the door. Therefore, problems remain.

SUMMARY

Therefore, it is a primary object, feature, or advantage of the present invention to improve over the state of the art.

It is a further object, feature, or advantage of the present invention to provide a specialized concrete tool which may be used to provide consistent and uniform slope along the length of cement under the garage or overhead door.

It is a still further object, feature, or advantage of the present invention to provide a specialized concrete tool which is easy and convenient to use.

Another object, feature, or advantage of the present invention is to provide a method of finishing concrete especially in a transition area underneath where a garage or overhead door will hang.

Yet another object, feature, or advantage is to allow for garage doors or overhead doors to seal with concrete when in closed positions.

A still further object, feature, or advantage is to encourage water to run away from a garage door or overhead door.

One or more of these and/or other objects, features, or advantages of the present invention will become apparent from the specification and claims that follow. No single embodiment need provide each and every object, feature, or advantage. Different embodiments may have different objects, features, or advantages. Therefore, the present invention is not to be limited to or by any objects, features, or advantages stated herein.

According to one aspect, a concrete tool for use in transition areas for garage or overhead doors is provided. The concrete tool includes an elongated main body extending between a first and an opposite second end, wherein the main body extends at a slope upwardly from the first end to the opposite second end. The concrete tool further includes a right angle portion extending upwardly from the first end of the elongated main body and then outwardly in order to rest on a top of concrete form, the right angle portion comprising a first generally vertical portion extending generally upwardly from the elongated main body and a second generally horizontal portion extending outwardly from the first generally vertical portion. The concrete tool may include a first post extending vertically upwardly from the elongated main body proximate the first end with a first grip positioned on the first post. The concrete tool may include a second post extending upwardly from the elongated main body proximate the second end with a second grip positioned on the second post.

According to another aspect, a concrete tool for use in a transition area between garage or overhead doors includes an elongated main body extending between a first and an opposite second end, wherein the main body extends at a slope upwardly from the first end to the opposite second end. The concrete tool further includes a right angle portion extending upwardly from the first end of the elongated main body and then outwardly, the right angle portion comprising a first generally vertical portion extending generally upwardly from the elongated main body and a second generally horizontal portion extending outwardly from the first generally vertical portion. The concrete tool further includes a first handle mounted proximate the first end of the elongated main body and a second handle mounted proximate the second end of the elongated main body. In an operative position, the right angle portion fits over a concrete form with the second generally horizontal portion riding along the concrete form as an operator of the concrete tool uses the first handle and the second handle to move the concrete tool across the transition area.

BRIEF DESCRIPTION OF THE DRAWINGS

Illustrated embodiments of the disclosure are described in detail below with reference to the attached drawing figures, which are incorporated by reference herein.

DETAILED DESCRIPTION

The invention is a specialized concrete tool for used in laying concrete in situations where a garage or overhead door will seal with the concrete. The flat plane achieved with this concrete tool allows rubber stripping of an overhead door to seal evenly across its length. The angle of the tool provides a uniform slope all the way across a transition area allowing water to run away from the door.

Figure 1:
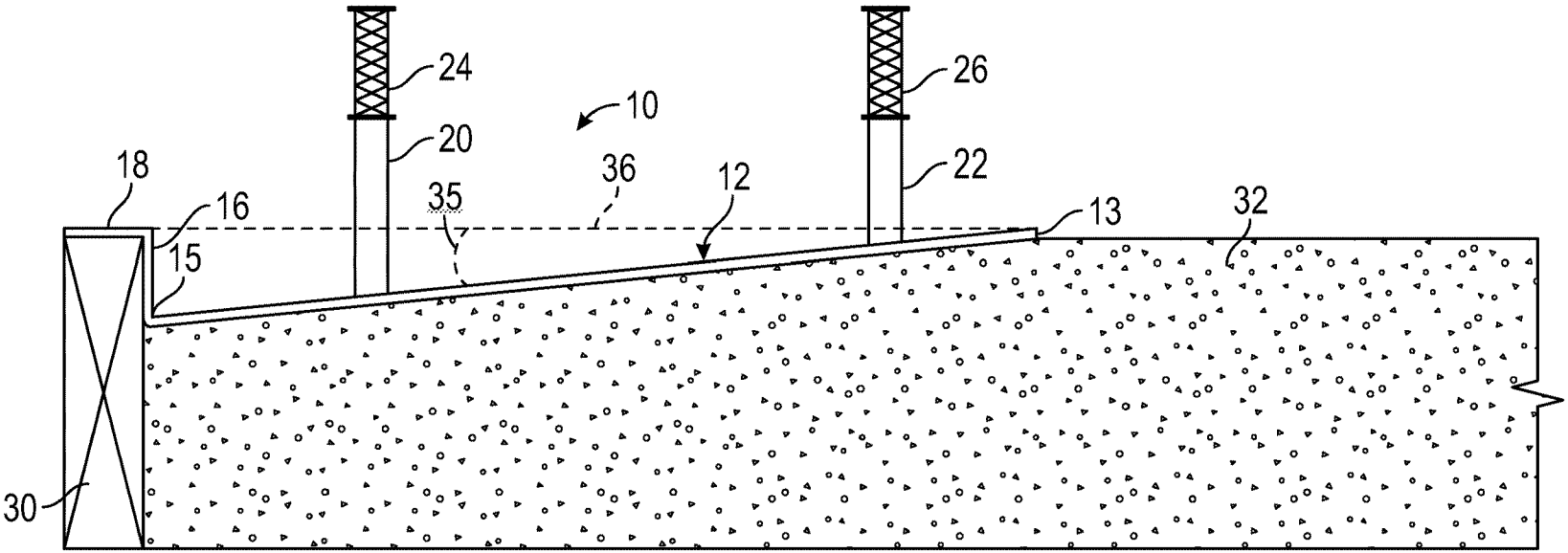
FIG. 1 illustrates one embodiment of a concrete tool being used along a length of cement associated with a garage or overhead door.

FIG. 1 illustrates one embodiment of a concrete tool 10 being used along a length of concrete associated with a garage or overhead door. As shown in FIG. 1, the concrete tool 10 has an elongated main body 12 with a first end and an opposite second end. A first post 20 extends upwardly from the elongated main body 12 proximate the first end and a second post 22 extends upwardly from the elongated main body 12 proximate the second end. The first post 20 has a first handle or grip 24. The second post 22 has a second handle or grip 26. The first handle or grip 24 and the second handle 26 or grip may be insulating grips as shown. Although any number of types of grips may be used, one type of grip that may be used is a motorcycle type grip. Such grips may be formed of plastic or rubber and are generally comfortable for a user. The insulating grips may be particularly advantageous in winter time so that an operator is not gripping cold metal. The first post 20 and the second post 22 each extend generally vertically upward proximate opposite ends of the concrete tool. The edges of the elongated main body 12 may be beveled.

The first post 20 and the second post 22 may extend vertically upward in operation as shown in FIG. 1. This means that due to the slope of the elongated main body 12, the first post 20 and the second post 22 are not extending exactly perpendicularly with the elongated main body 12. Similarly, a right angle portion 14 is not extending exactly perpendicularly with the elongated main body 12. Also, note that the first post 20 and the second post 22 may have different lengths such that the first post 20 is longer than the second post 22. Thus, when in an operative position such as shown in FIG. 1, the tops of the first handle or grip 24 and the second handle or grip 26 are in proximate alignment. This may provide greater comfort and ease of use for an individual using the concrete tool 10.

The elongated main body 12 of the concrete tool 10 has a top side and an opposite bottom side. The bottom side is smooth. A stiffener may be present along the top side of the elongated main body 12 in order to assist in preventing flexing. The stiffener may take on any number of forms. For example, the stiffener may include one or more stiffening ribs positioned along the elongated main body 12. The stiffener may be formed integrally with the elongated main body 12. Edges of the elongated main body 12 may be beveled. The elongated main body 12 may be made of the same type of materials used for standard trowels such as stainless steel. The end 13 of the elongated main body 12 may be turned slightly upward.

The right angle portion or bracket 14 is at one end of the elongated main body 12. The right angle portion 14 may include a first portion 16 extending generally upward and a second portion 18 extending generally outward from a top portion of the first portion 16. In operation, the right angle portion or bracket 14 may fit over a concrete form 30 with the angle between the first portion 16 and the second portion 18 being a right angle or substantially a right angle.

The elongated main body 12 extends between a first end 13 and opposite second end 15. The elongated main body 12 extends at a slope angle 35. The slope angle 35 may be defined as the angle between the line 36 extended from the top of the right angle bracket 14 to the top surface of the concrete slab and the elongated. The elongated main body 12 may be of different lengths such as twenty (20) inches, sixteen (16) inches, twelve (12) inches, etc. The length of the elongated main body 12 preferably corresponds with a desired width of the transition area. While the longer length may be more appropriate for industrial or agricultural structures, the shorter length may be more appropriate for residential structures. Of course, other lengths may be used. The slope may be of different lengths such as one (1) inch, one and one half (1½) inch, two (2) inches. Of course, other slopes could be used. A set of concrete tools may include a plurality of different concrete tools having different lengths and different slopes. With use of the tool 10, resulting concrete 32 thus may have a transition area with a slope.

Figure 2:
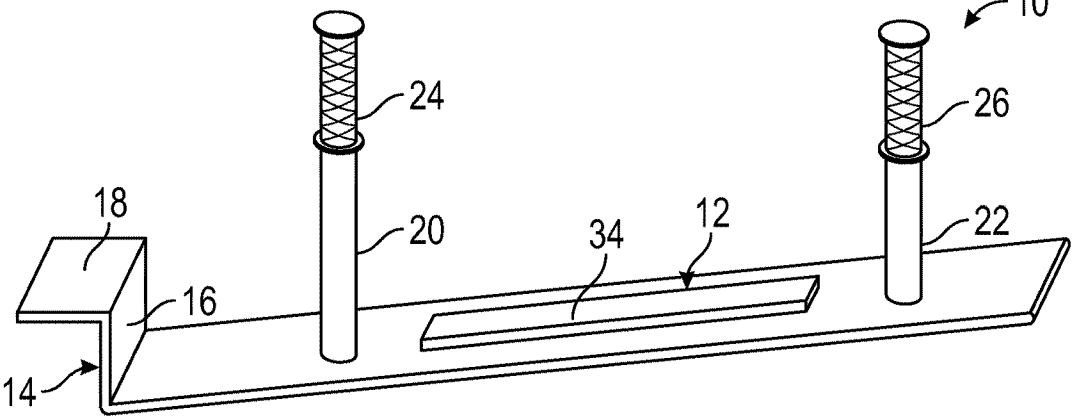
FIG. 2 is a perspective view of the concrete tool with a stiffener present.

FIG. 2 shows another view of a concrete tool 10. One or more stiffeners such as a stiffening rib 34 may be present. The one or more stiffeners 34 assist in preventing flexing. There may be an upward bend on each end of the elongated main body 12 of the concrete tool 10. In addition, as shown, edges of the elongated main body 12 may be beveled.

Figure 3:
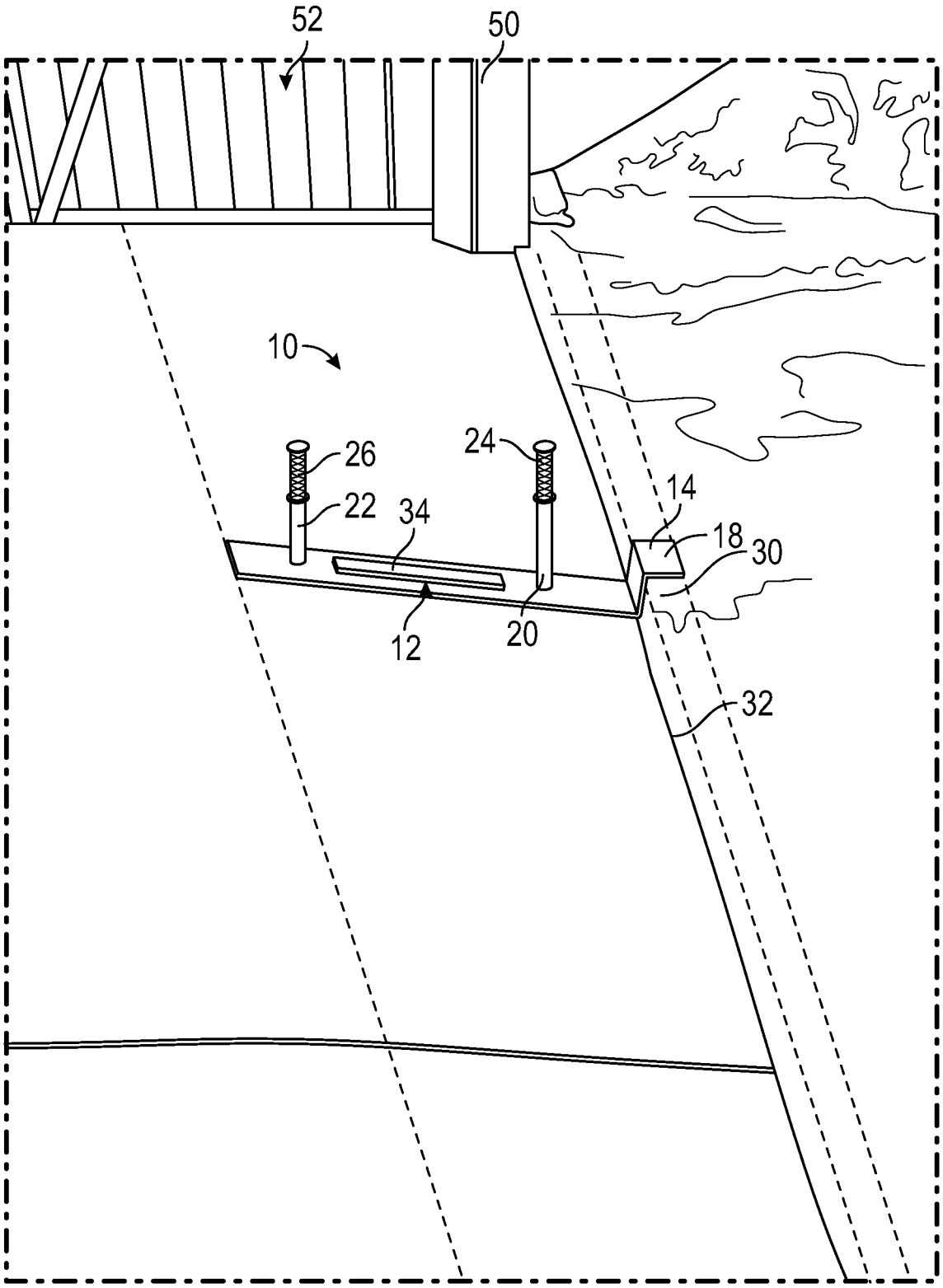
FIG. 3 illustrates use of the concrete tool, with the concrete tool riding along a concrete form.

FIG. 3 shows another view of the concrete too 10 in use. When in an operative position as shown, the right angle portion fits over a concrete form with the second generally horizontal portion riding along the concrete form as an operator of the concrete tool uses the first handle and the second handle to move the concrete tool across the transition area.

The basic structure includes a right angle bracket or portion 14 which fits over a concrete form at one end. An elongated main body 12 extends at a gradual slope upward in the opposite direction. A stiffener may be present along a top side of this elongated portion 12 to prevent flexing. Two handles with grips 24, 26 extend generally vertically upward at opposite ends of the device 10. The edges may be beveled. The basic structure may be made of the same materials as standard trowels such as steel, magnesium alloys, or other types of materials.

The invention is not to be limited to the particular embodiments described herein. In particular, the invention contemplates numerous variations in the angle or slope of the tool, the length and width of the tool, the placement of the handles, the grip on the handles where present, and other structural variations. The foregoing description has been presented for purposes of illustration and description. It is not intended to be an exhaustive list or limit any of the invention to the precise forms disclosed. It is contemplated that other alternatives or exemplary aspects are considered included in the invention. The description is merely examples of embodiments, processes or methods of the invention. It is understood that any other modifications, substitutions, and/or additions can be made, which are within the intended spirit and scope of the invention.

What is claimed is:

1. A concrete tool for use in transition areas for garage or overhead doors, the concrete tool comprising:

a right angle portion for resting on a top of a concrete form and extending vertically downwardly from the top of the concrete form;

an elongated main body extending between a first and an opposite second end, wherein the main body extends linearly at a slope upwardly from a bottom of the right angle portion at the first end to the opposite second end at an acute angle corresponding to a desired angle for concrete in the transition areas;

the right angle portion extending upwardly from the first end of the elongated main body along a side of the concrete form and then outwardly in order to rest on the top of the concrete form, the right angle portion comprising a first generally vertical portion extending generally upwardly from the elongated main body and a second generally horizontal portion extending outwardly from the first generally vertical portion;

a first post extending vertically upwardly from the elongated main body proximate the first end;

a first grip positioned on the first post;

a second post extending upwardly from the elongated main body proximate the second end;

a second grip positioned on the second post.

2. The concrete tool of claim 1 wherein the elongated main body comprises beveled edges.

3. The concrete tool of claim 1 wherein each of the first grip and the second grip comprise plastic.

4. The concrete tool of claim 1 further comprising a stiffener positioned along the elongated main body to assist in preventing bending.

5. The concrete tool of claim 4 wherein the stiffener comprises a stiffening rib.

6. The concrete tool of claim 1 wherein the first post extends vertically upward a first distance and wherein the second post extends vertically upward a second distance, the first distance greater than the second distance.

7. A concrete tool for use in a transition area between garage or overhead doors, the concrete tool comprising:

a right angle portion for resting on a top of a concrete form and extending vertically downwardly from the top of the concrete form;

an elongated main body extending between a first and an opposite second end, wherein the main body extends linearly at a slope upwardly from a bottom of the right angle portion at the first end to the opposite second end at an acute angle corresponding to a desired angle for concrete in the transition area;

the right angle portion extending upwardly from the first end of the elongated main body and then outwardly, the right angle portion comprising a first generally vertical portion extending generally upwardly from the elongated main body and a second generally horizontal portion extending outwardly from the first generally vertical portion;

a first handle mounted proximate the first end of the elongated main body; and a second handle mounted proximate the second end of the elongated main body;

wherein in an operative position, the right angle portion fits over a concrete form such that the first generally vertical portion rests against a side of the concrete form and the second generally horizontal portion rests against a top of the concrete form with the second generally horizontal portion riding along the top of the concrete form as an operator of the concrete tool uses the first handle and the second handle to move the concrete tool across the transition area with an entire length of the elongated main body in contact with the concrete.

8. The concrete tool of claim 7 wherein the elongated main body comprises beveled edges.

9. The concrete tool of claim 7 further comprising a stiffener positioned along the elongated main body to assist in preventing bending.

10. The concrete tool of claim 9 wherein the stiffener comprises a stiffening rib.

* * * * *